US006508689B1

(12) United States Patent
Mikkelsen et al.

(10) Patent No.: US 6,508,689 B1
(45) Date of Patent: Jan. 21, 2003

(54) TOY BUILDING SET

(75) Inventors: Kaj S. Mikkelsen, Billund (DK); Hans Damgård Nielsen, Billund (DK); Kim Pagel, Billund (DK); Carsten Røn, Billund (DK); Erik Fuglsang, Kolding (DK); Erik Bach, Billund (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/807,668

(22) PCT Filed: Oct. 13, 1999

(86) PCT No.: PCT/DK99/00545

§ 371 (c)(1),
(2), (4) Date: Jun. 25, 2001

(87) PCT Pub. No.: WO00/21628

PCT Pub. Date: Apr. 20, 2000

(30) Foreign Application Priority Data

Oct. 14, 1998 (DK) ..... 1998 01306

(51) Int. Cl.[7] ..... A63H 33/06
(52) U.S. Cl. ..... 446/108; 446/128; 446/487
(58) Field of Search ..... 446/102, 104, 446/108, 116, 120, 121, 124, 128, 424, 487, 109

(56) References Cited

U.S. PATENT DOCUMENTS

| | | | | | |
|---|---|---|---|---|---|
| 4,826,464 | A | | 5/1989 | Bertrand | |
| 5,049,104 | A | * | 9/1991 | Olsen | 403/156 |
| 5,172,534 | A | * | 12/1992 | Milner et al. | 446/104 |
| 5,209,693 | A | * | 5/1993 | Lyman | 403/157 |
| 5,582,488 | A | * | 12/1996 | Dudley et al. | 16/367 |
| 5,645,463 | A | * | 7/1997 | Olsen | 446/104 |
| 5,897,417 | A | * | 4/1999 | Grey | 403/340 |

FOREIGN PATENT DOCUMENTS

| | | |
|---|---|---|
| FR | 2 534 484 | 4/1984 |
| GB | 2 288 551 | 10/1995 |
| WO | WO 98/30808 | 7/1998 |

* cited by examiner

*Primary Examiner*—Jacob K. Ackun
(74) *Attorney, Agent, or Firm*—Pitney, Hardin, Kipp & Szuch LLP

(57) ABSTRACT

A toy building set comprising a plurality of building elements which each are provided with hinge parts, first and second types of hinge parts being shaped complementarily in such a manner that the hinge parts on two building elements may be interconnected releasably so that they form a hinge link between the building elements. The first type of hinge parts is provided with a toothing arranged at a specific distance from the common hinge axis, and the second type of hinge parts comprises a first group which is provided with a toothing arranged at the specific distance from the common hinge axis and a second group of hinge parts which is not provided with such a toothing, said toothings on the first type of hinge parts and on the first group of the second type of hinge parts being directed oppositely to each other in such a manner that they engage each other when the hinge parts are interconnected.

11 Claims, 4 Drawing Sheets

TOY BUILDING SET

The present invention relates to a toy building set comprising a plurality of building elements which each are provided with hinge parts, said hinge parts comprising a first type of hinge parts and a second type of hinge parts, said first and second types of hinge parts being shaped complementarily in such a manner that the hinge parts on two building elements may be interconnected releasably so that they form a hinge link between the building elements, whereby the building elements may be rotated about the common hinge axis defined by the hinge link.

Such toy building sets are known today in numerous embodiments, where the elements provided with hinge parts of course serve to construct structures which contain a hinge function.

The hinge parts of the known toy building sets are thus formed for specific purposes, such as to make it possible to orient the two building elements at an arbitrary angle with respect to each other. An example of this is known from GB Patent Application No. 2 288 551, which discloses a building system comprising building elements which are provided with hinge parts suitable for hinged interconnection of two elements. The building set thus comprises two different hinge types both of which allow building elements to be angled at an arbitrary angle with respect to each other.

FR patent application No. 2 534 484 discloses another system comprising a number of building elements, each having hinge parts for releasably hinged interconnection of two elements, and where the hinge parts allow the elements to be angled at an arbitrary angle with respect to each other.

U.S. Pat. No. 5 582 488 discloses another building system which comprises a link or the interconnection of e.g. toy building elements, said link being provided with hinge parts which have a toothing engaging a corresponding toothing on another link upon interconnection, thereby allowing the two links to be interconnected and angled at discrete angles with respect to each other.

Accordingly, the object of the present invention is to provide a toy building set of the type mentioned in the opening paragraph which, with a few subcomponents, allows construction of both hinge functions that permit arbitrary angling of two building elements with respect to each other, and hinge functions which facilitate mutual angling of the building elements in discrete positions with respect to each other.

This is achieved according to the present invention in that the first type of hinge parts has a toothing arranged at a specific distance from the common hinge axis, and that the second type of hinge parts comprises a first group which is provided with a toothing arranged at the specific distance from the common hinge axis and a second group of hinge parts which is not provided with such a toothing, said toothings on the first type of hinge parts and on the first group of the second type of hinge parts being directed oppositely to each other in such a manner that they engage each other when the hinge parts are interconnected.

Thus, according to the invention, it is ensured that a hinge connection capable of being angled arbitrarily or continuously as well as another hinge connection capable of easily assuming a plurality of discrete angular positions may be built using just three basically different elements, as the first type of hinge parts, notwithstanding this is provided with a toothing at any time, may be incorporated in the building of both of the above-mentioned situations. A further effect of this is also that in a given construction in which a possible hinge structure is desirably to be changed from assuming a plurality of discrete angular positions to assume arbitrary angular positions or vice versa, this will merely require that just one of the incorporated building elements with hinge parts is to be replaced, thereby making it easier for the user to change functions in a given toy building set.

In a preferred embodiment, the complementarily shaped hinge parts are shaped in such a manner that at least one of these is forcibly deformed elastically by interconnection or separation of the hinge parts. Separate elements for the interconnection of the hinge parts, such as a hinge bolt or the like, may hereby be omitted, as the hinge parts may be interconnected in an easy manner with snap effect.

It is particularly advantageous if the toothings on the complementarily shaped hinge parts have teeth of a given shape and height, and if the complementarily shaped hinge parts are arranged in such a manner that they may be moved a distance with respect to the common hinge axis, said distance being greater than the height of the teeth, in such a manner that the complementary hinge parts on two building elements interconnected by means of the complementary hinge parts are not separated because of rotation of the two building elements with respect to each other about the common hinge axis. The elements may hereby be rotated at different discrete angles with respect to each other without the hinge parts being released from each other.

The first type of hinge parts may advantageously comprise two female flanges which are positioned at a mutual distance at the side of each other so that each of the two female flanges on the first type of hinge parts has a substantially plane female side face facing the corresponding female side face on the other one of the two female flanges, whereby the two female flanges form a space defined by the female side faces, said female side faces being substantially parallel and oriented perpendicularly to the common hinge axis. The female side faces may hereby form effective guide faces which prevent undesirable twisting and thereby disengagement of the hinge parts from each other.

In this connection it is additionally advantageous if the second type of hinge parts forms two substantially plane and mutually parallel male side faces which may be inserted between the two female side faces on the two female flanges on the first type of hinge parts, and if the female side faces on the first type of hinge parts and the male side faces on the second type of hinge parts are provided with complementarily shaped pins and holes which define the hinge axis when the hinge parts are interconnected.

In this connection, the second type of hinge parts may advantageously be formed by a single male flange on which the two male side faces are provided so as to face oppositely to each other, so that all the elastic deformation of the hinge parts caused by the assembly of the hinge is accommodated by the female parts.

In a preferred embodiment of the invention, the female flanges are secured to a building element at one end and at the end facing away from the building element where they are positioned, and the toothing consists of a plurality of teeth provided on a circular arc which has its centre in the common hinge axis, each of said teeth facing away from the common hinge axis. Other things being equal, it is hereby possible to achieve a toothing with relatively large teeth, which however, nevertheless allow relatively small angles between the individual discrete angles of the hinged building elements.

In this connection, it is advantageous if the toothing on the second type of hinge parts is formed by a plurality of teeth which are aligned with each male side face, and which face the common hinge axis.

The toothing on the second type of hinge parts may advantageously be formed by one or two teeth, and if the toothing on the first type of hinge parts is additionally formed by a larger number of teeth, a relatively great total mutual angular rotation of the two building elements may be achieved, with a given number of teeth.

The toothing on the first type of hinge parts may thus advantageously extend over an angle of more than 90° and preferably over a circular arc of about 180° about the common hinge axis, thereby achieving an extremely great movability of the hinge link.

The invention will be described more fully below with reference to the drawing, in which FIG. 1 is a perspective view showing a first building element according to the present invention, seen obliquely from above.

Figure 1:
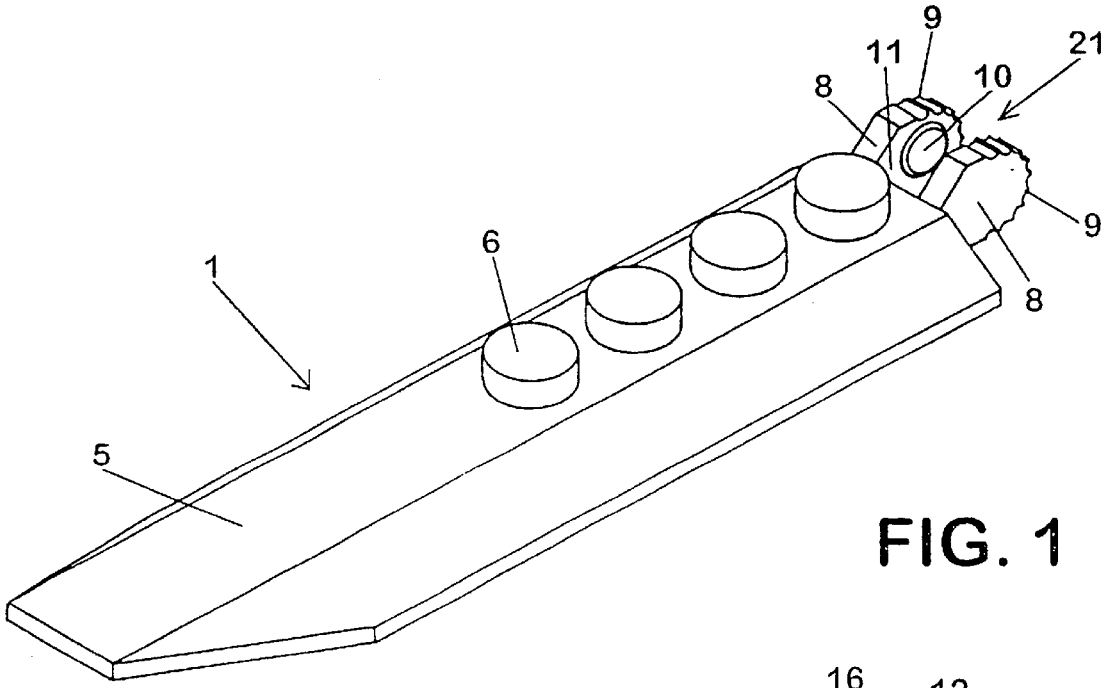

FIG. 1 thus shows a building element 1 comprising a body part 5 which is provided with four coupling studs 6, said coupling studs 6 allowing other building elements with complementary coupling parts to be mounted releasably on the coupling studs 6. The building element 1, like others of the building elements shown in the other figures, may be used as elements in a complete building system. For clarity, the figures do not show such other building elements.

According to the invention, the building element 1 of FIG. 1 is provided with a first hinge part 21 comprising two female flanges 8 which protrude from the body part 5 of the building element 1, said female flanges forming two substantially parallel female side faces 11 which face each other and are positioned at a well-defined distance from each other. Each of these female side faces is provided with pins 10 which are shaped as truncated cones. In addition, the female flanges 8 each have a toothing 9 which is arranged on a distal end of the female flanges 8 with respect to the body part 5 of the building element 1. Each of these toothings comprises a plurality of teeth positioned on a circular arc which has its centre in the centre of the pins 10 and thereby in the hinge axis defined by the pins.

Figure 2:
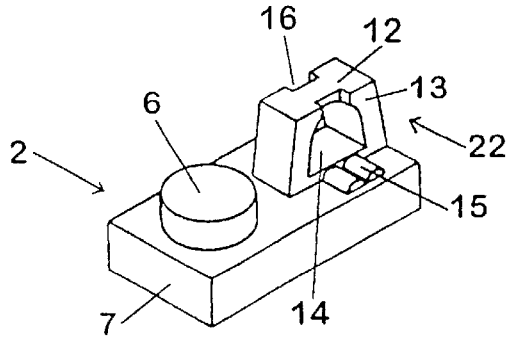
FIG. 2 is a perspective view showing a second building element according to the present invention, seen obliquely from above.

FIG. 2 shows another element 2, which likewise has a body part 7 provided with a coupling stud which allows releasable interconnection of the element 2 and another element. The element 2 is provided with a second type of hinge part 22 which is complementary with the first type of hinge part 21 shown in FIG. 1, so that these hinge parts 21, 22 may be interconnected to form a hinge link with a common hinge axis.

As will be seen, the hinge part shown in FIG. 2 comprises a male flange 12 which has two oppositely directed and parallel male side faces 13, so that the male flange 12 has a width which allows the male flange 12 just to be inserted between the female flanges 8 on the element 1 shown in FIG. 1. The insertion of the male flange 12 between the two female flanges 8 forces the two female flanges 8 elastically away from each other until the pins 10 extend into the hole 14 in the male flange 12 shown in FIG. 2. It is ensured hereby that the pins 10 may be rotated in the hole 14, thereby providing a hinge function with a common hinge axis.

To facilitate the insertion of the male flange 12 between the two female flanges 8, the male flange 12 is formed with grooves 16, which are shaped such that the pins 10 may be moved in these grooves 16, but such that the width of the grooves 16 is smaller than the greatest width of the pins 10 at the root of the truncated cone, and such that a certain elastic deformation of the two female flanges 8 is required for the pins 10 to be pressed through and past the grooves 16.

Figure 3:
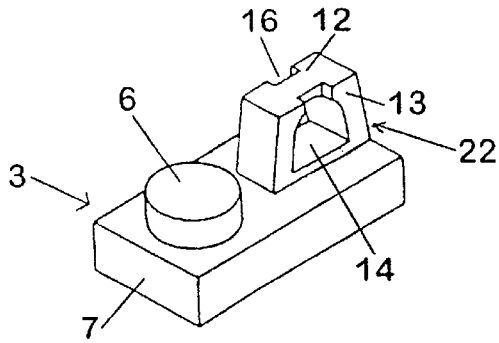
FIG. 3 is a perspective view showing a third building element according to the present invention, seen obliquely from above.

FIG. 3 shows a third element 3 according to the invention, which basically corresponds to the element 2 shown in FIG. 2, with the sole difference that the toothing 15 shown in FIG. 2 is omitted.

Thus, in an expedient combination of the above-mentioned three elements from FIGS. 1, 2 and 3, hinges having different properties may be formed, viz. a link connection permitting substantially free mutual rotation of two building elements with respect to each other, and another link connection which requires an increased force to rotate the building elements with respect to each other, or makes it easy to angle the two building elements in a plurality of discrete mutual angles.

Figure 4:
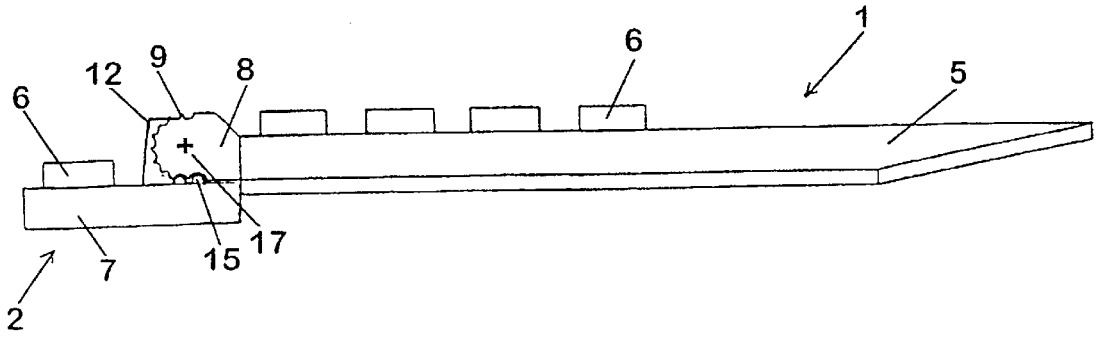
FIG. 4 is a view showing the building elements of FIGS. 1 and 2 in the assembled state, seen from the side.
Figure 5:
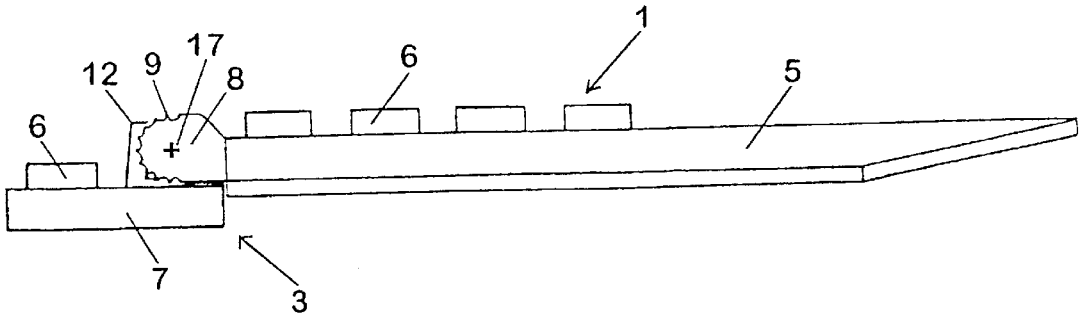
FIG. 5 is a view showing the building elements of FIGS. 1 and 3 in the assembled state, seen from the side.

This is shown more clearly in FIGS. 4 and 5, where FIG. 4 shows the building elements 1, 2 shown in FIGS. 1 and 2, said elements being interconnected as stated above, it being visible that the toothing 9 or the female flanges 8 on the one element 1 engages the toothing 15 on the other element 2, so that the two building elements are interconnected in such a manner that they may be rotated mutually about the common axis 17.

As the two toothings 9, 15 engage each other when the elements 1, 2 are assembled as shown, and as the female flanges 8 are elastic and allow the conical pin to move with respect to the hinge axis without the hinge parts 21, 22 being disengaged, the two elements 1, 2 may easily be caused to assume a plurality of discrete well-defined mutual angles with respect to each other. The number of and the angle between these positions will thus depend on the number of teeth of the toothings 9, 15.

When the elements shown in FIGS. 1 and 3 are interconnected, the toothing 9 will not have any technical function, as will be seen in FIG. 5, because the element 3, as stated above, is not provided with a toothing which engages the toothing 9 on the first element 1. The first element 1 may thereby be rotated freely to assume an infinite number of angular positions with respect to the element 3, so that a substantially free rotation is achieved here, but, if desired, with friction between the hinge parts on the building elements.

Figure 6:
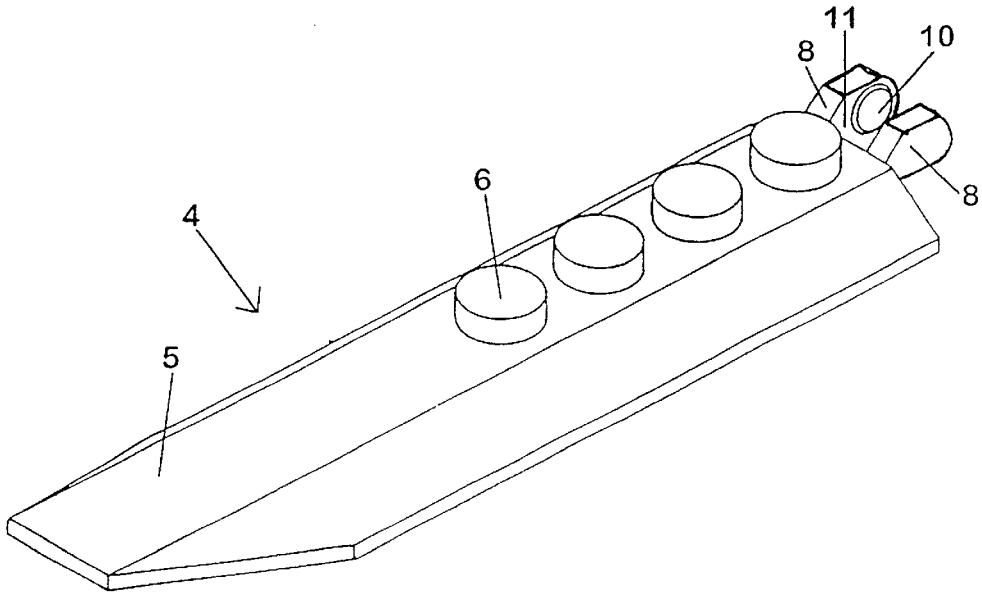
FIG. 6 is a perspective view show ing a fourth building element according to the present invention, seen obliquely from above.

FIG. 6 shows a fourth building element 4 which basically corresponds to the building element 1 shown in FIG. 1, but with the difference that the toothing 9 shown in FIG. 1 is removed from the element 4.

Figure 7:
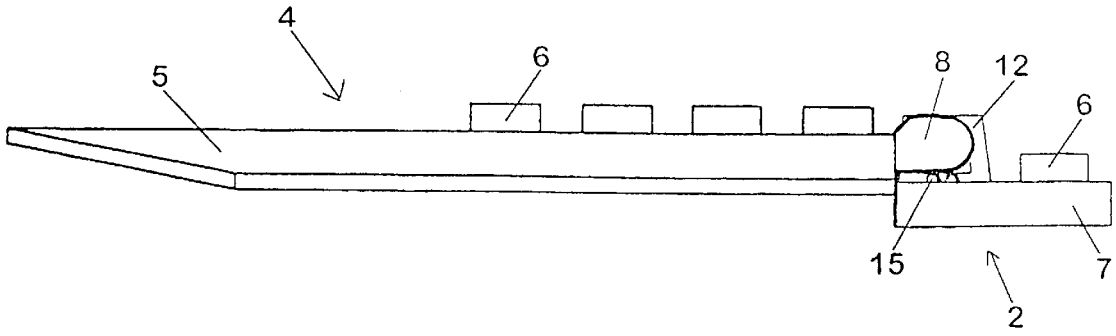
FIG. 7 is a view showing the building elements of FIGS. 2 and 4 in the assembled state, seen from the side.

It appears from FIG. 7 that the element 4 shown in FIG. 6 may be interconnected with the element shown in FIG. 2, without this resulting in a hinge link which will assume a plurality of discrete mutual angular positions, since the missing toothing on the element 4 means that the toothing 15 on the element 2 has no technical function in this link connection.

Thus a building set comprising all the elements shown in the figures may be used flexibly, so that the user has a great freedom with respect to establishing hinge links with discrete angular positions as well as without. But it is also clear that a reasonable flexibility may be achieved solely by using three different hinge parts, viz. a first hinge part provided with toothing, and a complementarily shaped hinge part which is present in a version with and without toothing.

Figure 8:
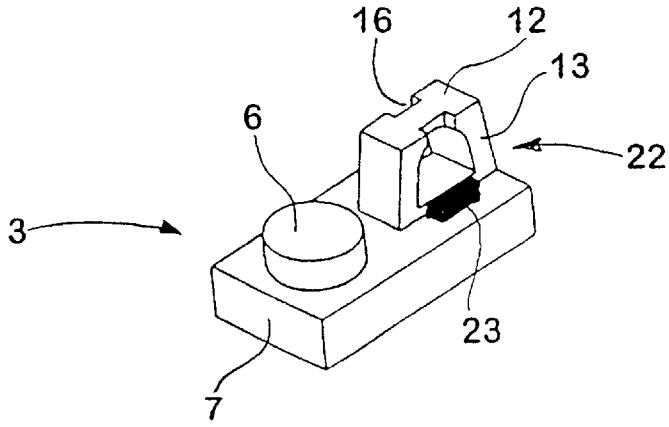
FIG. 8 is a perspective view of an alternative embodiment of the element shown in FIG. 3, seen obliquely from above.
Figure 9:
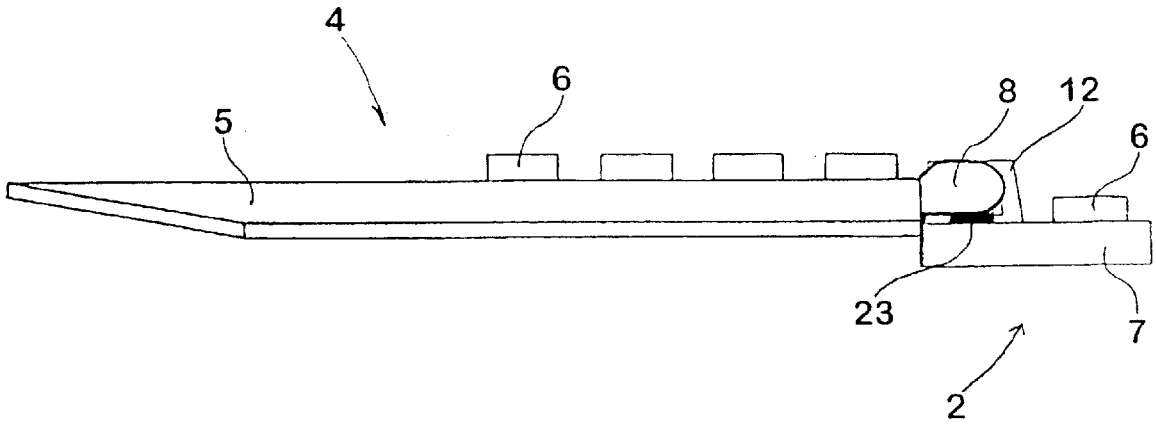
FIG. 9 is a lateral view of the building elements shown in FIGS. 6 and 8 in the assembled state thereof.

Now, FIG. 8 illustrates an alternative embodiment of the building element shown in FIG. 3 wherein the building element 3 corresponds exactly to the building element shown in FIG. 3, except that a block 23 of friction-increasing material, such as rubber or the like is provided, in such a manner that, when the building element 3, as shown in FIG. 8, is interconnected with a building element 4 as shown in FIG. 6, a hinge connection will be obtained illustrated as shown in FIG. 9 from which it will appear that the two female flanges 8 with their extreme ends abut on the block 23 of the friction-increasing material and thus in themselves mean that an increased resistance is accomplished against mutual rotation of the two building elements 3,4 relative to each other.

What is claimed is:

1. A toy building set comprising:

a plurality of building elements in which each building element is provided with hinge parts, said hinge parts comprising a first type of hinge parts and a second type of hinge parts, said first and second types of hinge parts being complementarily shaped such that the hinge parts on two of said building elements may be releasably interconnected to form a hinge link between the building elements, whereby the building elements may be mutually rotated about a common hinge axis defined by the hinge link wherein said first type of hinge parts has a toothing arranged at a specific distance from the common hinge axis, and wherein said second type of hinge parts includes a first group of hinge parts having a toothing arranged at the specific distance from the common hinge axis and a second group of hinge parts which is not provided with such a toothing, such that said toothing on the first type of hinge parts and said toothing on the first group of the second type of hinge parts are directed opposite each other to engage each other when said hinge parts are interconnected.

2. A toy building set according to claim 1 wherein said complementarily shaped hinge parts are shaped in such a manner that at least one said complementarily shaped hinge part is deformed elastically by the interconnection or separation of the complementarily shaped hinge parts.

3. A toy building set according to claim 2 wherein said toothings on the complementarily shaped hinge parts have teeth of a given shape and height, and wherein said complementarily shaped hinge parts are arranged in such a manner that they may be rotated a distance with respect to the common hinge axis, said distance being greater than the height of the teeth, whereby the complementary hinge parts on the building elements interconnected by means of the complementary hinge parts are not separated because of the rotation of the two building elements with respect to each other about the common hinge axis.

4. A toy building set according to claim 1 wherein said first type of hinge parts includes two female flanges with each of the two female flanges having a substantially plane female side facing a corresponding female side face on the other of the two female flanges so that the two female flanges form a space defined by the female side faces, said female side faces being substantially perpendicular to the common hinge axis.

5. A toy building set according to claim 4 wherein said second type of hinge parts includes two substantially plane and parallel male side faces spaced from each other to be insertable between the two female side faces, said female side faces and said male side faces provided with complementarily shaped pins and holes that define the common hinge axis when said complementary shaped hinge parts are interconnected.

6. A toy building set according to claim 4 wherein said second type of hinge parts is formed by a single male flange with two male side faces facing away from each other.

7. A toy building set according to claim 4 wherein said female flanges are secured to the building element at one end and have a toothing at the end facing away from the building element where said female flanges are secured, said toothing having a plurality of teeth arranged on a circular arc with a center of the circular arc in the common hinge axis, each of the teeth facing away from the common hinge axis.

8. A toy building set according to claim 6 wherein said toothing on the second type of hinge parts is formed by a plurality of teeth aligned with said male side faces, and which face the common hinge axis.

9. A toy building set according to claim 1 wherein said toothing on the second type of hinge parts is formed by at least one tooth and said toothing on the first type of hinge parts is formed by a number of teeth with the number of teeth formed greater than the amount of teeth formed on said second type of hinge parts.

10. A toy building set according to claim 9 wherein said toothing on the first type of hinge parts extends over a circular arc of more than 90 degrees.

11. A toy building set according to claim 1 wherein said second group of the second type of hinge parts includes hinge parts having friction-increasing elements arranged in such a manner that the friction-increasing elements abut on the complementarily shaped hinge parts following the interconnection of two building elements.

* * * * *